US005086940A

United States Patent [19]

Parker et al.

[11] Patent Number: 5,086,940

[45] Date of Patent: Feb. 11, 1992

[54] CONTAINER FOR NEWSPAPERS

[76] Inventors: Donna M. Parker, 180 Queen Mary Road, Apt. 405, Kingston, Ontario, K7M 2A8; John Madden, Apt. 11, 15 Manitou Crescent W, Amherstview, Ontario, K7N 1C1, both of Canada

[21] Appl. No.: 740,112

[22] Filed: Aug. 5, 1991

[51] Int. Cl.[5] ..... B65D 53/00

[52] U.S. Cl. ..... 220/214; 220/476; 206/807

[58] Field of Search ..... 220/214, 476; 206/807

[56] References Cited

U.S. PATENT DOCUMENTS 2,250,977 7/1941 Walker ..... 220/214

4,396,113 8/1983 Gail et al. ..... 220/214

*Primary Examiner*—Joseph Man-Fu Moy

*Attorney, Agent, or Firm*—Richard J. Hicks

[57] ABSTRACT

A simple, inexpensive storage container for newspapers and the like is described for attachment to an apartment door or the like, such that papers can be inserted from the top but cannot be removed until the door is opened so as to expose an open side of the container. The container is secured in tamper proof manner by adhesive or simple slot and screw means.

3 Claims, 2 Drawing Sheets

CONTAINER FOR NEWSPAPERS

FIELD OF INVENTION

This invention relates to a container for receipt and safe storage of articles such as newspapers and magazines.

BACKGROUND OF INVENTION

Delivery of newspapers and magazines and the like to residences, particularly in large multiple occupancy dwellings, such as apartment blocks is not without problem, particularly as large letter slots are infrequently provided, theft of articles left outside the door is relatively common and scattered newspapers are unsightly. Attempts to solve this problem have been made in the past and attention is directed to Canadian patent 1,203,787 issued 29 Apr. 1986 which describes a rectangular container provided with an open top and an inwardly directed flange to prevent withdrawal of a newspaper therethrough once inserted, and an open side which abuts the door jamb so that the container is closed when the door is closed and open to retrieve the stored newspaper when the apartment door is opened. The container is affixed to the door by a resilient clip means so that it can be placed at any height on the door edge without marking it. Screws can be used to secure the container at a selected height. The clip means is however relatively expensive to produce as high grade metal must be employed and, furthermore several sizes of clip are required to accommodate doors of different thicknesses. Such a clip also contravenes fire regulations in many jurisdictions as it destroys the integrity of the door seal and will invalidate the fire rating of the door.

OBJECT OF INVENTION

It is an object of the present invention to provide a tamper proof container for newspapers and the like which overcomes the attachment problems of the prior art and which eliminates the resilient means for securing the container to the door.

BRIEF STATEMENT OF INVENTION

By one aspect of this invention there is provided a tamper proof container for receiving and temporarily storing newspapers and the like and mountable on a door comprising:

a substantially rectangular container having slot means in one side thereof adapted for insertion of a newspaper therethrough and including means to preclude withdrawal of said newspaper therethrough; said container having an open side located, when said container is mounted in operative position on said door, closely adjacent to a door jamb thereof such that when said door is closed access to said open side is precluded and when said door is open access to said open side is facilitated for removal of said newspaper; and tamper proof means between a rear face of said container and a face of said door for securing said container to said face to said door in said operative position.

DETAILED DESCRIPTION OF PREFERRED EMBODIMENTS

Figure 1:
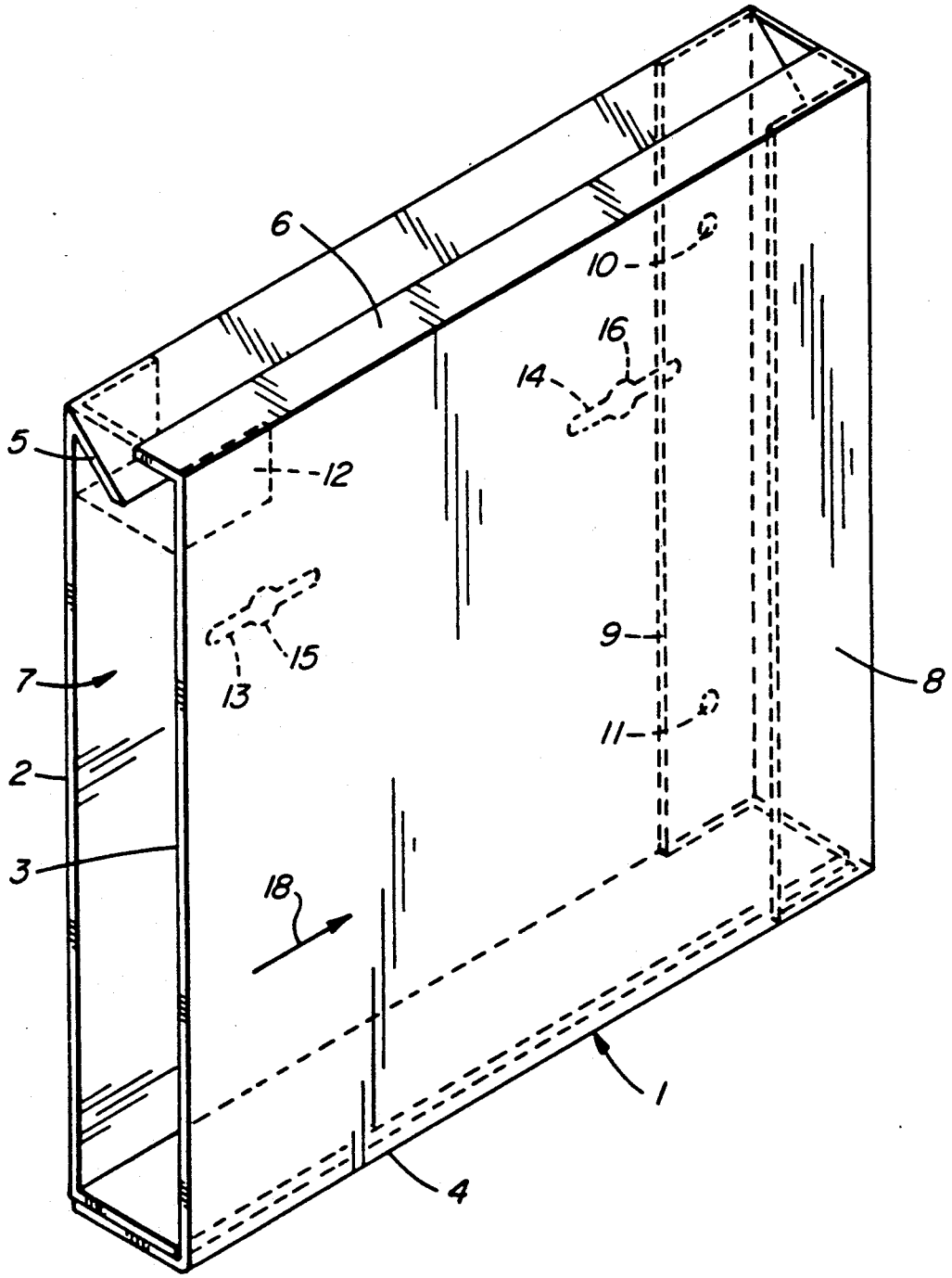
FIG. 1 is an isometric view, partly in section of a container according to the present invention.

In FIG. 1 there is shown a rectangular container 1 having a back face 2, a front face, a bottom 4, an inwardly directed flange 5 at the top and a partial top cover 6. The sides 7, 8 are both open. An end cap section 9 is designed to be inserted into either of open sides 7, 8 and engage snugly with front and back faces 32 respectively. End cap 9 is provided so that the box can be affixed to either a left hand or right hand opening door. The open side is, of course, always placed against the hinge side of the door jamb on an inwardly opening door and on the lock side of the door jamb on an outwardly opening door. End cap 9 is secured in place by any convenient fastening means, such as an adhesive or rivets 10, 11. Container 1 can be fabricated in sheet metal or may be moulded in a thermoplastic or thermosetting resin composition. If desired a supplemental end cap 12 may be provided to close the slot area adjacent flange 5. The container 1 can be affixed to the door end by any convenient means such as adhesive means or screw means. As shown in FIG. 1 elongated slots 13, 14 may be provided in rear face 2, each having a central circular portion 15, 16 adapted to pass a screw head (not shown) mounted in door 17. When the door is in the open position as shown in FIG. 4, the container 1 can be mounted on the door 17 by inserting the screw heads through openings 15, 16 and sliding the container to the right in the direction of arrow 18 (as seen in FIG. 1) so that when door 17 is closed, as in FIG. 3, the screw heads cannot be withdrawn from slots 13, 14. Obviously when mounting on the right of a door the container must be slid to the left, to ensure tamper proof fastening.

Figure 2:
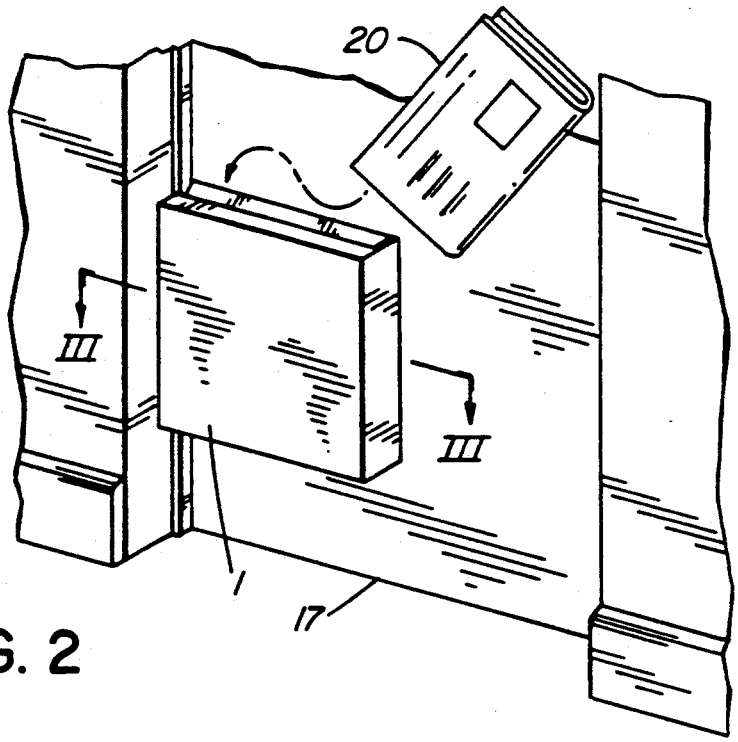
FIG. 2 is a sketch showing the container of FIG. 1 in position on a door.
Figure 3:
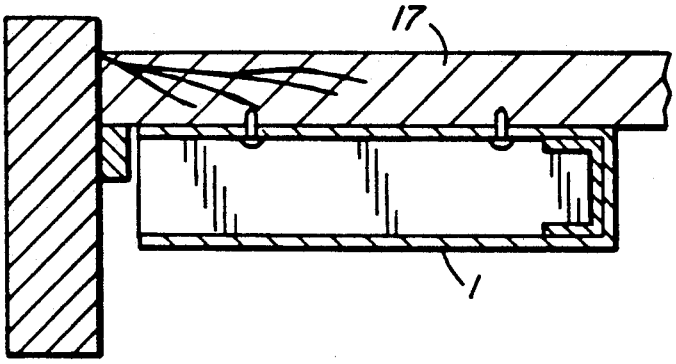
FIG. 3 is a section on III—III of FIG. 2 with the door closed.
Figure 4:
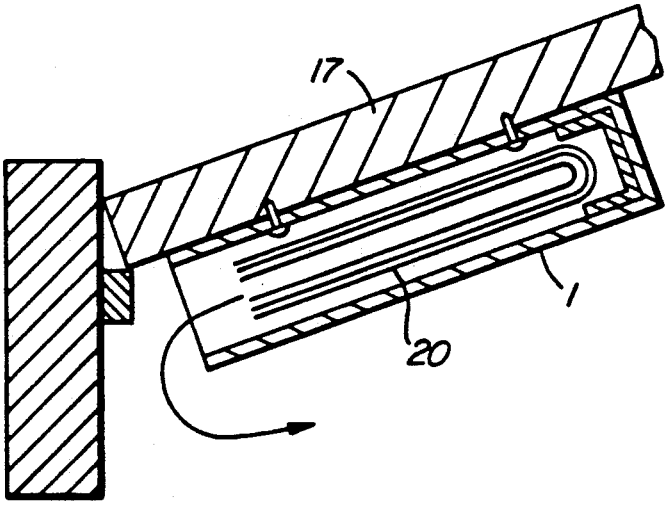
FIG. 4 is a section on III—III of FIG. 2 with the door open.

As seen in FIGS. 2, 3 and 4, a paper or magazine 20 can be inserted through the top of the container 1 and when the door 17 is closed as in FIG. 3, it cannot easily be withdrawn through the top as the flange 5 directs a person's fingers away from the stored newspaper. However on opening door 17 as shown in FIG. 4, the paper 20 can be withdrawn through the now exposed open side, thus providing a simply constructed, inexpensive, yet tamper proof container for publications etc. which is particularly suitable for use in an apartment building or the like. It will be appreciated that many modifications can be made without departing from the scope of this invention. For example, in order to reduce material cost rear face 2 may be reduced to upper and lower lips through which mounting slots 15, 16 can be provided.

We claim:

1. A tamper proof container for receiving and temporarily storing newspapers and the like and mountable on a door comprising:

a substantially rectangular container having slot means in one side thereof adapted for insertion of a newspaper therethrough and including means to preclude withdrawal of said newspaper therethrough;

said container having an open side located, when said container is mounted in operative position on said door, closely adjacent to a door jamb thereof such that when said door is closed access to said open side is precluded and when said door is open access to said open side is facilitated for removal of said newspaper;

and tamper proof means between a rear face of said container and a face of said door for securing said container to said face to said door in said operative position.

2. A container as claimed in claim 1 where said securing means comprises at least two slots in said rear face of said container adapted to receive fastening means secured in said door.

3. A container as claimed in claim 1 wherein said securing means comprises adhesive means.

* * * * *